US009285776B1

(12) United States Patent
Custer et al.

(10) Patent No.: US 9,285,776 B1
(45) Date of Patent: Mar. 15, 2016

(54) BAND TIGHTENING SYSTEM

(71) Applicant: VORTIC, LLC, State College, PA (US)

(72) Inventors: Robert Thomas Custer, State College, PA (US); Tyler Wolfe, State College, PA (US); Frank Barber, State College, PA (US); Mac Frederick, State College, PA (US); Jonathan Kolenda, State College, PA (US); Zachary Ryan, State College, PA (US); Sean McWhirter, State College, PA (US); James McMahon, State College, PA (US); Erick Bennes, State College, PA (US)

(73) Assignee: VORTIC, LLC, Fort Collins, CO (US)

( * ) Notice: Subject to any disclaimer, the term of this patent is extended or adjusted under 35 U.S.C. 154(b) by 48 days.

(21) Appl. No.: 14/214,786

(22) Filed: Mar. 15, 2014

Related U.S. Application Data

(60) Provisional application No. 61/799,592, filed on Mar. 15, 2013.

(51) Int. Cl.
*A43C 11/16* (2006.01)
*G04B 37/22* (2006.01)
*A44C 5/22* (2006.01)

(52) U.S. Cl.
CPC .. *G04B 37/22* (2013.01); *A44C 5/22* (2013.01)

(58) Field of Classification Search
CPC ..... A43C 11/165; A44C 5/22; G04B 37/22
USPC ..... 368/282
See application file for complete search history.

(56) References Cited

U.S. PATENT DOCUMENTS

| | | | | |
|---|---|---|---|---|
| 4,748,726 | A * | 6/1988 | Schoch | 24/68 SK |
| 4,796,829 | A * | 1/1989 | Pozzobon et al. | 242/389 |
| 5,042,177 | A * | 8/1991 | Schoch | 36/50.5 |
| 5,600,874 | A * | 2/1997 | Jungkind | 24/68 SK |
| 7,600,660 | B2 * | 10/2009 | Kasper et al. | 224/162 |
| 8,468,657 | B2 * | 6/2013 | Soderberg et al. | 24/68 SK |
| 8,516,662 | B2 * | 8/2013 | Goodman et al. | 24/68 SK |
| 2005/0237864 | A1 * | 10/2005 | Albisetti | 368/282 |

* cited by examiner

*Primary Examiner* — Sean Kayes
(74) *Attorney, Agent, or Firm* — Patterson & Sheridan, LLP

(57) ABSTRACT

The present disclosure generally relates to a tightening apparatus, a wristband having the same, and a wristwatch having the same. In one embodiment, a plurality of pieces are coupled together and to a housing, and have one or more wires running through at least a first piece and a second piece of the plurality of pieces. The first and second pieces of the plurality of pieces are spaced a distance apart. The housing partially encloses at least a ratchet having a center axis, and a spool coupled to the ratchet, the spool being rotatable about an axis that is collinear with the center axis. The one or more wires are coupled to the spool, and are configured to wind around the spool when the spool rotates. As the spool rotates, the distance between at least the first and second pieces of the plurality of pieces is reduced.

22 Claims, 8 Drawing Sheets

BAND TIGHTENING SYSTEM

CROSS-REFERENCE TO RELATED APPLICATIONS

This application claims benefit of U.S. Provisional Patent Application Ser. No. 61/799,592, filed Mar. 15, 2013, which is herein incorporated by reference.

BACKGROUND OF THE INVENTION

1. Field of the Invention

Embodiments of the present invention generally relate to a tightening apparatus, a wristband having the same, and wristwatch having the same.

2. Description of the Related Art

In recent years, the popularity of technology and gadgets worn on the wrist has greatly increased. Examples of such technology and gadgets include watches, heart rate monitors, MP3 players, Fitbits, flash drives and mobile phones. As many of these gadgets are made to be worn all day or during vigorous exercise and activity, it is imperative that gadgets worn on the wrist fit tightly to work efficiently and correctly.

Often times, these gadgets are worn on the wrist by a band of connected metal links or a semi-circle band made of rubber. Rubber is known to stretch out over time and does not hold its elasticity, and the bands typically come in only one size. The individual metal links are removable to make the size of the wrist band customizable, but removing the links rarely makes the wrist band fit tightly and properly. Removing one too many links makes the wrist band too small to fit, or too tight to be comfortable. Not removing enough links makes the wrist band too large, and the gadget does not sit snugly or comfortably where it belongs. Additionally, a professional is often required to remove the links, thus, the links are not user adjustable and can be an inconvenience to be removed.

Therefore, there is a need in the art for an improved method and apparatus for modifying the size of a wrist band in order for the technology and gadgets worn on the wrist to work properly and to fit comfortably.

SUMMARY OF THE INVENTION

The present disclosure generally relates to a tightening apparatus, such as a wristband. In one embodiment, a plurality of pieces are coupled together and to a housing, and have one or more wires running through at least a first piece and a second piece of the plurality of pieces. The first and second pieces of the plurality of pieces are spaced a distance apart. The housing partially encloses at least a ratchet having a center axis, and a spool coupled to the ratchet, the spool being rotatable about an axis that is collinear with the center axis of the ratchet. The one or more wires are coupled to the spool, and are configured to wind around the spool when the spool rotates. As the spool rotates, the distance between at least the first and second pieces of the plurality of pieces is reduced.

In one embodiment, a tightening apparatus comprises a housing having a plurality of pieces coupled together, a ratchet having a center axis and coupled to at least a first piece of the plurality of pieces and a spool coupled to the ratchet, wherein the spool is rotatable about an axis that is collinear with the center axis of the ratchet. One or more wires are coupled to the spool and at least a second piece of the plurality of pieces. The one or more wires are configured to wind around the spool when the spool rotates, and the second piece is movable from a first position spaced a first distance from the first piece to a second position spaced a second distance from the first piece, wherein the second distance is less than the first distance.

In another embodiment, a tightening apparatus comprises a housing, a plurality of pieces coupled together and to the housing, a central sun gear having a center axis and a plurality of teeth, wherein the sun gear is enclosed in the housing, two planetary gears coupled to the sun gear, wherein the planetary gears have a plurality of teeth and are enclosed in the housing, and a spool coupled to the sun gear, wherein the spool is rotatable about an axis that is collinear with the center axis of the sun gear. A bezel having a plurality of teeth is interlocked with the teeth of the planetary gears, and three posts extending perpendicularly from the bottom of the housing are disposed centrally through the sun gear and the planetary gears. One or more wires are coupled to the spool and at least a second piece of the plurality of pieces. The one or more wires are configured to wind around the spool when the spool rotates. The second piece is movable from a first position spaced a first distance from a first piece of the plurality of pieces to a second position spaced a second distance from the first piece, and wherein the second distance is less than the first distance.

In another embodiment, a tightening wristwatch comprises a housing having a plurality of pieces coupled together, and a ratchet having a center axis and coupled to at least a first piece of the plurality of pieces and a last piece of the plurality of pieces, wherein the ratchet has a plurality of teeth. A spool is coupled to the ratchet, wherein the spool is rotatable about an axis that is collinear with the center axis of the ratchet. A cog is perpendicular to the ratchet, wherein the teeth of the cog and the teeth of the ratchet are interlocked. A bezel is perpendicular to the cog and parallel with the ratchet, and the cog and bezel are interlocked. A watch including a watch face is coupled to the bezel, wherein the watch is coupled to the plurality of pieces to form a closed loop. One or more wires are coupled to the spool and at least a second piece of the plurality of pieces. The one or more wires are configured to wind around the spool when the spool rotates, and the second piece is movable from a first position spaced a first distance from the first piece to a second position spaced a second distance from the first piece, wherein the second distance is less than the first distance, and wherein the diameter of the loop is reduced.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

To facilitate understanding, identical reference numerals have been used, where possible, to designate identical elements that are common to the figures. It is contemplated that elements disclosed in one embodiment may be beneficially utilized on other embodiments without specific recitation.

DETAILED DESCRIPTION

In the following, reference is made to embodiments of the invention. However, it should be understood that the invention is not limited to specific described embodiments. Instead, any combination of the following features and elements, whether related to different embodiments or not, is contemplated to implement and practice the invention. Furthermore, although embodiments of the invention may achieve advantages over other possible solutions and/or over the prior art, whether or not a particular advantage is achieved by a given embodiment is not limiting of the invention. Thus, the following aspects, features, embodiments and advantages are merely illustrative and are not considered elements or limitations of the appended claims except where explicitly recited in a claim(s). Likewise, reference to "the invention" shall not be construed as a generalization of any inventive subject matter disclosed herein and shall not be considered to be an element or limitation of the appended claims except where explicitly recited in a claim(s).

The present disclosure generally relates to a tightening apparatus, such as a wristband. In one embodiment, a plurality of pieces are coupled together and to a housing, and have one or more wires running through at least a first piece and a second piece of the plurality of pieces. The first and second pieces of the plurality of pieces are spaced a distance apart. The housing partially encloses at least a ratchet having a center axis, and a spool coupled to the ratchet, the spool being rotatable about an axis that is collinear with the center axis. The one or more wires are coupled to the spool, and are configured to wind around the spool when the spool rotates. As the spool rotates, the distance between at least the first and second pieces of the plurality of pieces is reduced.

Figure 1A:
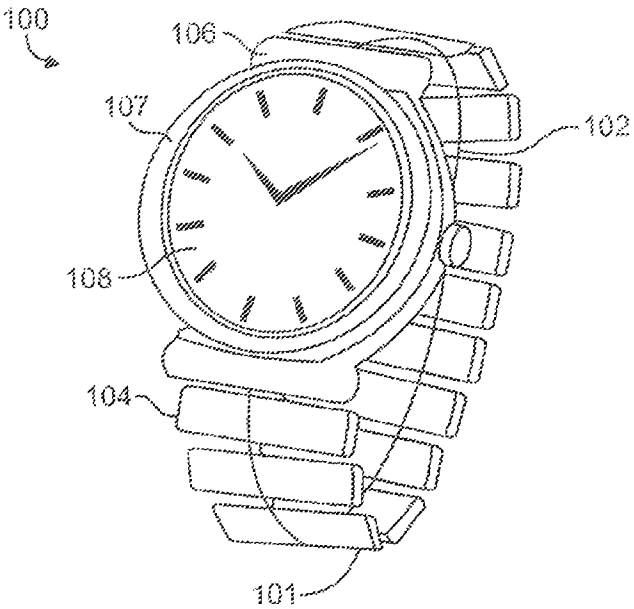
FIGS. 1A-1C illustrate a band, according to one embodiment of the invention.

FIG. 1A illustrates an isometric view of a device 100 that includes a housing 106 and a band 101, according to one embodiment. In the embodiment shown in FIGS. 1A-1C, the device 100 is a wrist watch. It is to be understood that the device 100 is not limited to a wrist watch or to being a device worn on the wrist. The band 101 comprises a plurality of pieces 104 that are coupled together and to the housing 106, where one or more wires 102 extend out from the housing 106 and run through the center of the plurality of pieces 104. The plurality of pieces 104 may be spaced some distance apart from one another. The plurality of pieces 104 may comprise metal and may be linkage pieces. The plurality of pieces 104 may be coupled to the housing 106 on both ends to form a closed loop. In another embodiment, the plurality of pieces 104 may be coupled at only one end to the housing 106 while the other end is fixedly coupled to a piece of the plurality of pieces 104. The one or more wires 102 may run through each piece of the plurality of pieces 104, or the one or more wires 102 may only run though a few pieces of the plurality of pieces 104.

Figure 1C:
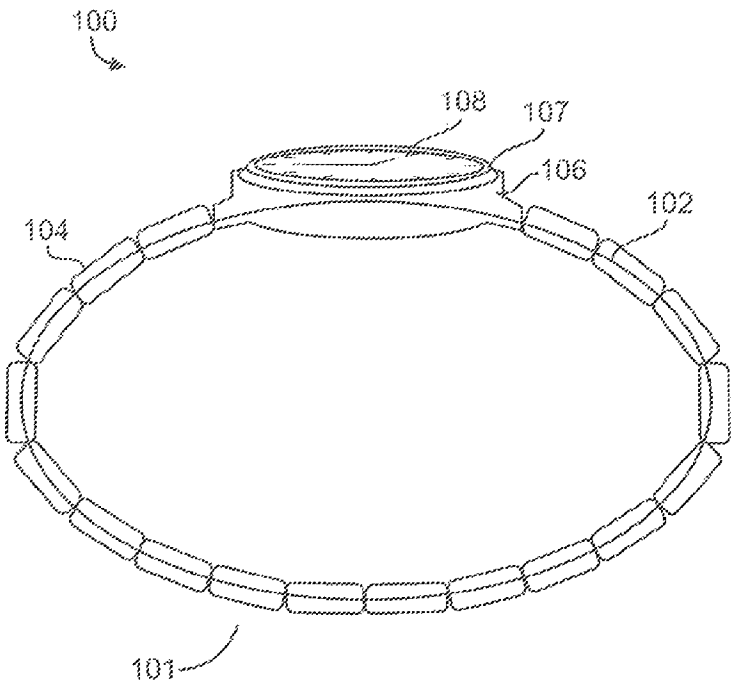
Figure 1B:
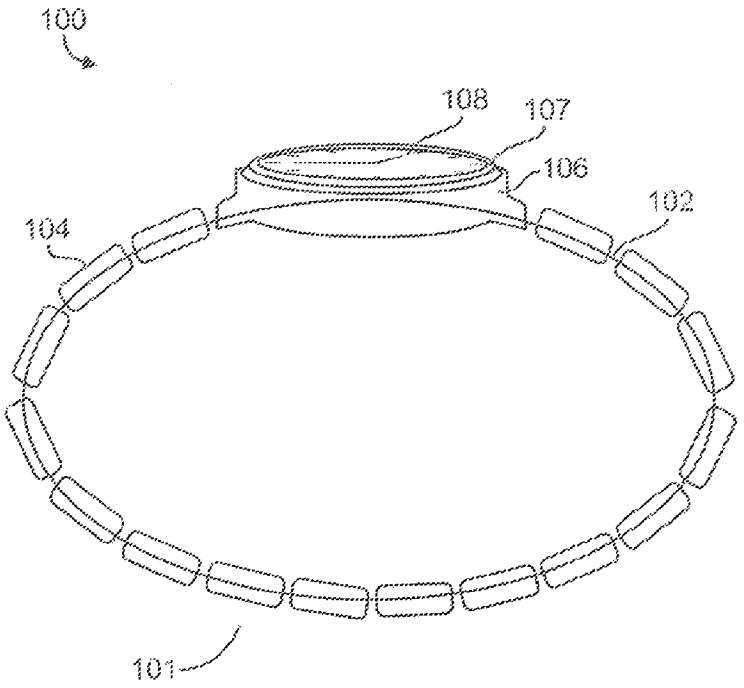

FIG. 1B shows a side view of the device 100 and the band 101. In the embodiment shown in FIG. 1B, the housing 106 is coupled to a watch face 108 and a bezel 107. As shown, the one or more wires 102 are loose, and a number of the plurality of pieces 104 are spaced apart and are not in direct contact with one another, although two or more pieces of the plurality of pieces 104 may be in direct contact with one another. As noted above, the band 101 is not limited to being a band specific for a watch, but could simply be a wrist band without a watch attached. The plurality of pieces 104 that make up the band 101 could be adapted to receive different attachments, such as different gadgets not limited to GPS devices, medical alert emblems, etc.

FIG. 1C shows a side view of the device 100 and the band 101 when the wire 102 is tightened. A number of the plurality of pieces 104 are in direct contact with one another, and the band 101 has a smaller diameter than the band 101 in FIG. 1B. Each piece of the plurality of pieces 104 may be in direct contact with one another, or two or more pieces of the plurality of pieces 104 may be space apart from one another.

Figure 2B:
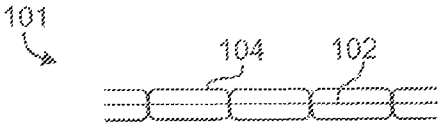
FIGS. 2A-2B illustrate the band when the tightness is varied.
Figure 2A:
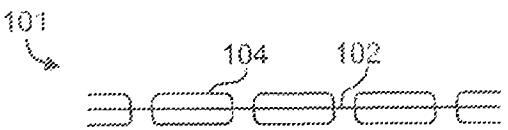

FIGS. 2A-2B show the band 101 when the tightness of the wire 102 is varied. FIG. 2A shows the wire 102 being slack. The plurality of pieces 104 are spaced apart from one another and the wire 102 may be visible between the pieces 104. FIG. 2B shows the wire 102 in a tightened state. The plurality of pieces 104 may all be in direct contact with one another, and the wire 102 may not be visible between the pieces 104.

Figure 3:
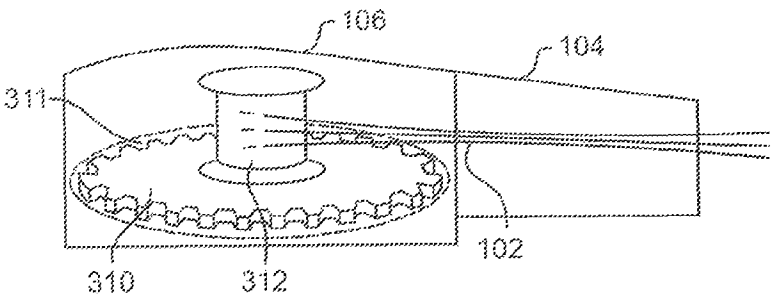
FIG. 3 shows an inside view of a housing.

The housing 106 encloses at least a spool 312 coupled to a ratchet 310, the ratchet 310 having a center axis and a plurality of teeth. The spool 312 extends perpendicularly from a surface of the ratchet 310, and is rotatable about an axis that is collinear with the center axis. The one or more wires 102 are coupled to the spool 312 at one end. FIG. 3 shows a side view of the inside of the housing 106 and the one or more wires 102 coupled to the spool 312. The ratchet 310 sits in a circular recess 311, the recess 311 having a greater diameter than the ratchet 310. The edge of the recess 311 prevents the wire 102 from contacting the teeth of the ratchet 310. In one example, the spool 312 has a smaller diameter than the ratchet 310. Any number of wires 102 may be coupled to the spool 312, and one end of the one or more wires 102 may be fixedly coupled to an end piece of the plurality of pieces 104. The spool 312 may be coupled to the surface of the ratchet 310 which faces the bezel 107, or the spool 312 may be coupled to the surface of the ratchet 310 that faces the bottom of the housing 106.

Figure 4:
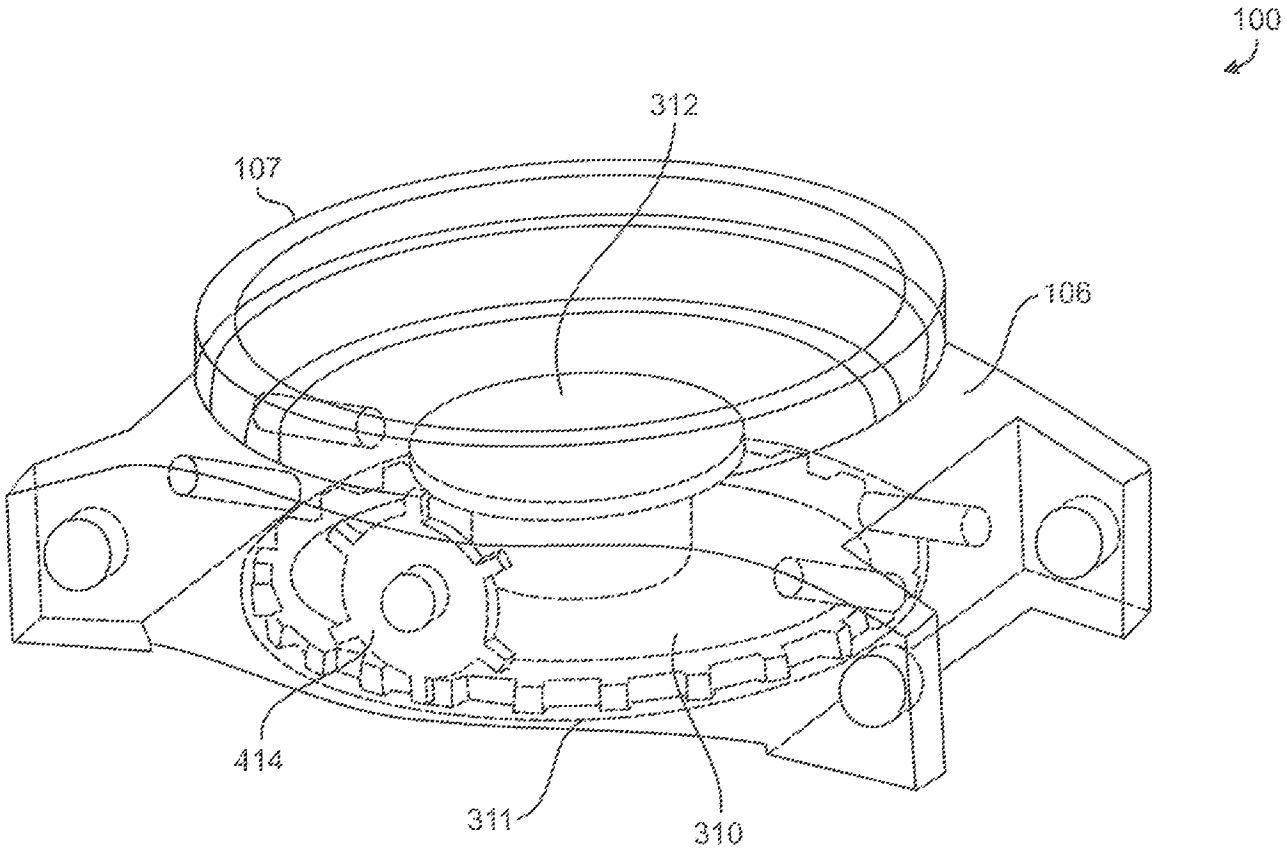
FIG. 4 illustrate various components of the housing of a watch integrated with a band, according to embodiments of the invention.

FIG. 4 illustrates the various components enclosed in a housing 106 of the device 100, according to one embodiment. In this embodiment, the ratchet 310 is operatively coupled to the bezel 107 through a cog 414. The cog 414 is perpendicular to the bezel 107 and may be coupled to the housing by a pin. The bezel 107 may have a plurality of teeth to facilitate operational rotation with the cog 414, and may be coupled to the watch face 108 or other device. For example, the bezel 107 may be coupled to a heart rate monitor or an MP3 player. The bezel 107 and/or the cog 414 may be excluded from the device entirely. The device is not limited to using a bezel 107 to attach the gadgets; the plurality of pieces 104 or the one or more wires 102 may be adapted to attach to the gadgets.

In one embodiment, rotation of the bezel 107 results in rotation of the cog 414 and hence, rotation of the ratchet 310. The spool 312 is coupled to the ratchet 310, and rotates simultaneously with the ratchet 310. The one or more wires 102 then wind around the spool 312, reducing the space between at least two pieces of the plurality of pieces 104. If the plurality of pieces 104 are coupled together to form a wristband 101, the diameter of the wristband 101 is reduced. The space between all pieces of the plurality of pieces 104 may be reduced. The plurality of pieces 104 may be excluded from the device, in which case the length of the one or more wires 102 extending out from the housing 106 would be reduced as the wire 102 is wound around the spool 312. It is to be understood the device 100 is not limited to being a device worn on the wrist. Rather, the device 100 may be used to secure any object to another object.

Figure 5:
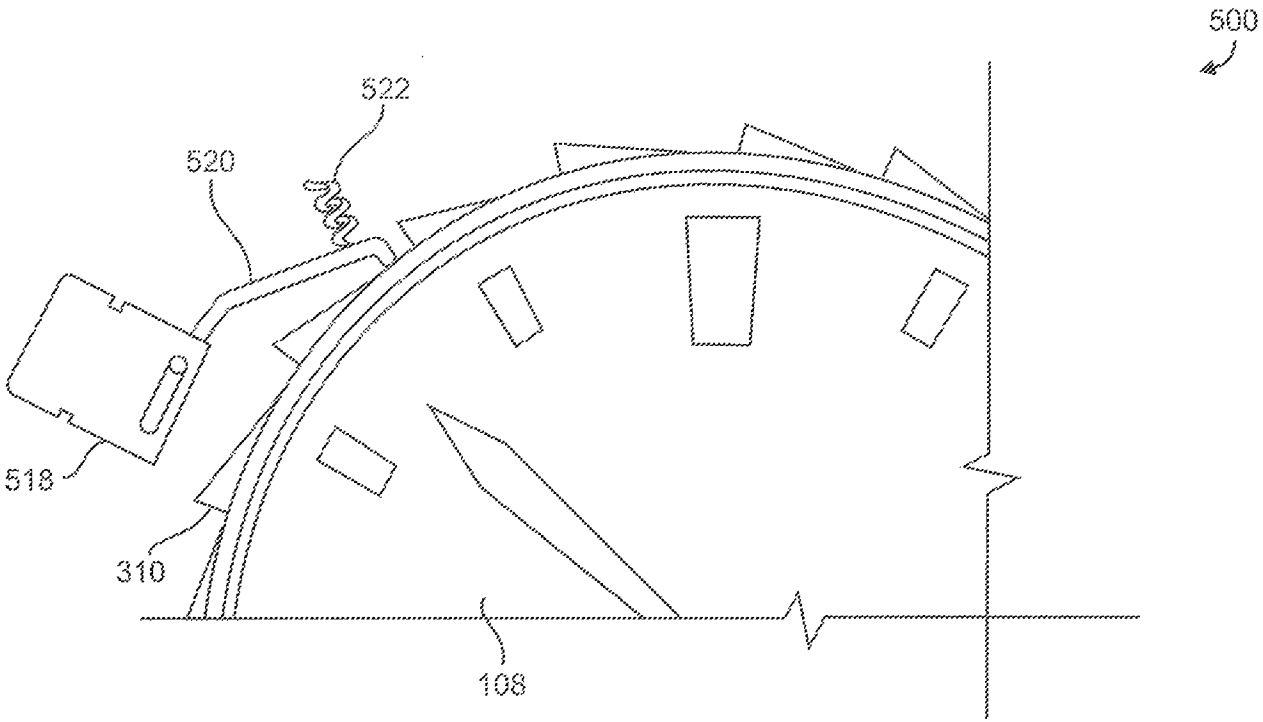
FIG. 5 illustrates a release mechanism.

FIG. 5 illustrates a release mechanism 500, according to one embodiment. Release mechanism 500 comprises a pawl 520, a spring 522 to bias the pawl 520, and a release button 518 adapted to actuate the pawl 520. As the bezel 107 (shown in FIG. 4) is rotated, the pawl 520 engages the teeth of the ratchet 310, acting as a locking mechanism. The spring 522 is located between the housing 106 (shown in FIG. 4) and the pawl 520, and is in its relaxed state when the pawl 520 is engaging the teeth of the ratchet 310. When the release button 518 is actuated, the spring 522 is compressed, and the pawl 520 disengages the teeth of the ratchet 310. Once the pawl 520 is disengaged from the teeth of the ratchet 310, the wire 102 unwinds from the spool 312, spacing the plurality of pieces 104 apart, and increasing the diameter of the wristband 101 if the plurality of pieces 104 have been coupled together to form a band 101. The release button 518 is partially exposed from the housing 106. The release button 518 may be exposed from any side of the housing 106, and the housing 106 may fully enclose the pawl 520 and the spring 522. While described as being engaged with the ratchet 310, it is contemplated that the release mechanism 500 may be engaged with the bezel 107.

In one embodiment, the apparatus excludes the bezel 107 and the cog 414. In this embodiment, the housing 106 encloses the ratchet 310 and the spool 312, and the spool 312 is coupled to a surface of the ratchet 310. The ratchet 310 has a center axis with which the spool 312 is rotatable about, and a plurality of teeth. One or more wires 102 are coupled to the spool 312, and run through the center of at least two pieces of the plurality of pieces 104. One end of the wire 102 may be fixedly coupled to an end piece of the plurality of pieces 104. The plurality of pieces 104 are coupled together and to the housing 106, and are spaced a distance apart. Rotation of the ratchet 310 results in the wire 102 being wound around the spool 312, reducing the distance between at least two pieces of the plurality of pieces 104. A pawl 520 is used to engage the teeth of the ratchet 310, acting as a locking mechanism. A release button 518 may be present and adapted to disengage the pawl 520 from the teeth of the ratchet 310, unlocking the system, and a spring 522 may be present to bias the pawl 520. The plurality of pieces 104 may be coupled together to form a wristband 101. The ratchet 310 may sit in a recess 311 which has a larger diameter than the ratchet 310, and the edge of the recess 311 may prevent the wire 102 from contacting the teeth of the ratchet 310. A portion of the ratchet 310 may be exposed from the housing 106. The plurality of pieces 104 may be configured to receive attachments, such as a heart rate monitor or an MP3 player. The plurality of pieces 104 may comprise metal and may be linkage pieces.

In another embodiment, a tightening apparatus involves a planetary gear system 600. The teeth of a bezel 607 interlock with the teeth of two planetary gears 624, which in one example are identical planetary gears 624. The two planetary gears 624 are operationally coupled by a central sun gear 610 that includes a plurality of teeth and a center axis. The teeth of the sun gear 610 are interlocked with the teeth of both planetary gears 624 to facilitate operational rotational there between. The planetary gears 624 in combination with the sun gear 610 act as part of the planetary gear system 600. A spool 612 is coupled to a first surface of the sun gear 610 and is rotatable about an axis that is collinear with the center axis of the sun gear 610. In one example, the spool 612 has a larger diameter than the sun gear 610, and is mounted in a position that does not interfere with the rotation of the sun gear 610 or the planetary gears 624. It is contemplated a gear ratio between the planetary gears 624 and the sun gear 610, and the relative sizes of the planetary gears 624 and the sun gear 610, may be adjusted to facilitate tailoring of the ease and speed of spooling the wire 102.

Figure 6A:
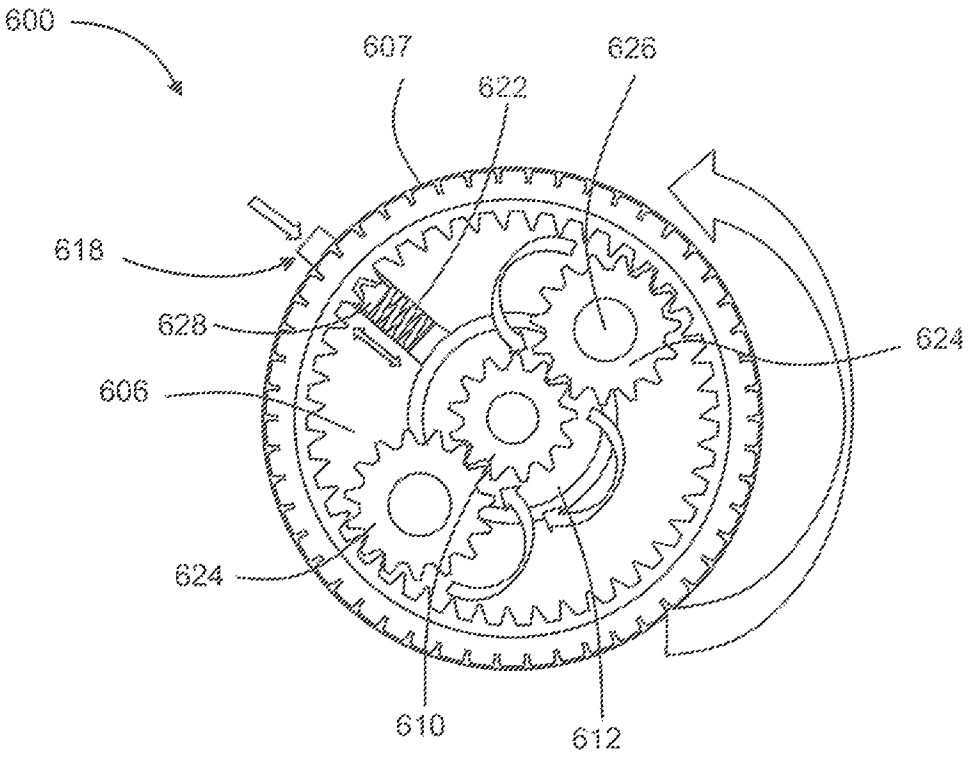
FIGS. 6A-6B illustrate a planetary gear system, according to one embodiment of the invention.
Figure 6B:
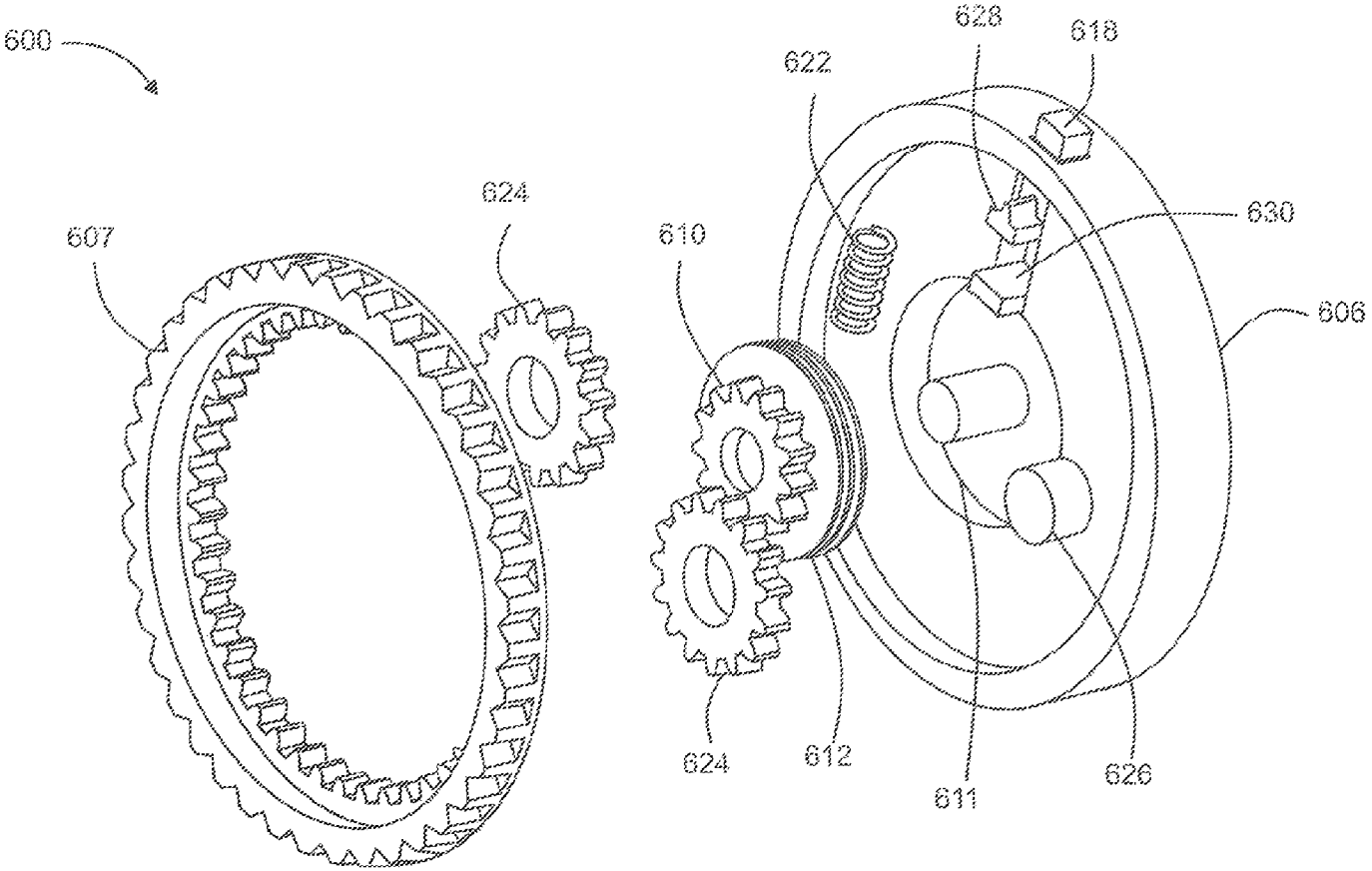

FIG. 6A illustrates the planetary gear system 600 according to one embodiment. FIG. 6B is an expanded view of the planetary gear system 600. The planetary gear system 600 may include the two planetary gears 624, the sun gear 610, and the spool 612 coupled to the sun gear 610, all of which are fully enclosed in a housing 606. Three posts 626 extend perpendicularly from the bottom of the housing 606 in a linear row. The two planetary gears 624 and the sun gear 610 rotate about the three posts, with the posts 626 disposed centrally through the gears. The center post shares a center axis with the sun gear 610, and extends from the center of a circular recess 611 which is disposed on the bottom of the housing 606. The spool 612 sits in the recess 611, the recess 611 having a larger diameter than the spool 612. A side wall of the recess 611 may have one or more cylindrical shafts or openings leading to the outside of a side wall of the housing 606. Coupled to the spool 612 are one or more wires 102, where the one or more wires 102 extend through the cylindrical shafts to the outside of the housing 606. A plurality of pieces 104 are coupled to the outside of the housing 106, and the one or more wires 102 continue to extend through the center of at least two pieces of the plurality of pieces 104. The first piece of the plurality of pieces 104 is coupled to the housing adjacent the cylindrical shafts to facilitate alignment of the wire 102 from the spool 612. A circular cover piece or press-fit lid with three circular openings therethrough may be used to prevent the components of the planetary gear system 600 from shifting in undesired directions. The three openings of the press-fit lid are positioned linearly with the three posts, and fit tightly over the three-posts so as the components of the planetary system 600 would be unable to shift under the press-fit lid.

In the embodiment shown in FIG. 6A, rotation of the bezel 607 results in rotation of the sun gear 610 operatively coupled thereto through the planetary gears 624. The spool 612 is coupled to the sun gear 610, and rotates simultaneously with the sun gear 610. The one or more wires 102 then wind around the spool 612, reducing the space between at least two pieces of the plurality of pieces 104. If the plurality of pieces 104 are coupled together to form a loop or wristband, the diameter of the loop or wristband is reduced. In the embodiment shown in FIGS. 6A-6B, the bezel 607 has two sets of teeth. One on the outer diameter of the bezel 607 and another on the inner diameter of the bezel 607. It is to be understood that the teeth on the outer diameter need not be present.

In the embodiment shown in FIGS. 6A-6B, the housing 606 may contain a second recess 630 which extends to the edge of the housing 606 and remains spaced from the first recess 611. In the second recess 630 lies a spring biased linear stopper piece 628, where the linear stopper piece 628 is disposed between a spring 622 and the bezel 607. The linear stopper piece 628 extends through an opening to the outside of the housing 606, where an exposed portion of the linear stopper piece 628 acts as a release button 618. The linear stopper piece 628 engages the teeth of the inner diameter of the bezel 607, allowing rotation in only one direction, and prevents the wire 102 from unspooling. The spring 622 is also disposed in the second recess 630 between the linear stopper piece 628 and the back wall of the second recess 630, and is in a relaxed state when the linear stopper piece 628 engages the teeth of the bezel 607. When the release button 618 is actuated, the spring 622 is compressed, and the linear stopper piece 628 disengages from the teeth of the bezel 607. Once the linear stopper piece 628 is disengaged from the teeth of the bezel 607, the wire 102 unwinds from the spool 612, and the plurality of pieces 104 are spaced apart. If the plurality of pieces 104 were coupled together to form a wristband, the diameter of the wristband is increased.

In the embodiment shown in FIGS. 6A-6B, the top side of the bezel 607 facing outward from the housing 606 may have a raised portion patterned with grooves to making gripping the bezel 607 easier. The bezel 607 may also be coupled to a watch 100 and a watch face 108, where the watch 100 would be disposed on the press-fit lid. The bezel 607 may be coupled to any gadget, such as a heart rate monitor or an MP3 player, and is not limited to a watch 100. It is to be understood the device is not limited to being a device worn on the wrist. The bezel 607 may be coupled to a perpendicular cog 414, in which case the cog 414 would be coupled to one of the planetary gears 624. The plurality of pieces 104 coupled to the housing 606 may comprise metal, and may be linkage pieces. The plurality of pieces 104 may be coupled to the housing 606 on both ends to form a wristband, or the plurality of pieces 104 may be coupled at only one end to the housing 106. Any number of wires 102 may be coupled to the spool 612, and any number of openings or cylindrical shafts may be formed in the side wall of the housing 606 to allow the wires 102 to linearly run through the plurality of pieces 104. The spool 612 may have a greater diameter than the sun gear 610. The plurality of pieces 104 may be excluded from the device, and the one or more wires 102 may be adapted to attach the gadgets.

Figure 7:
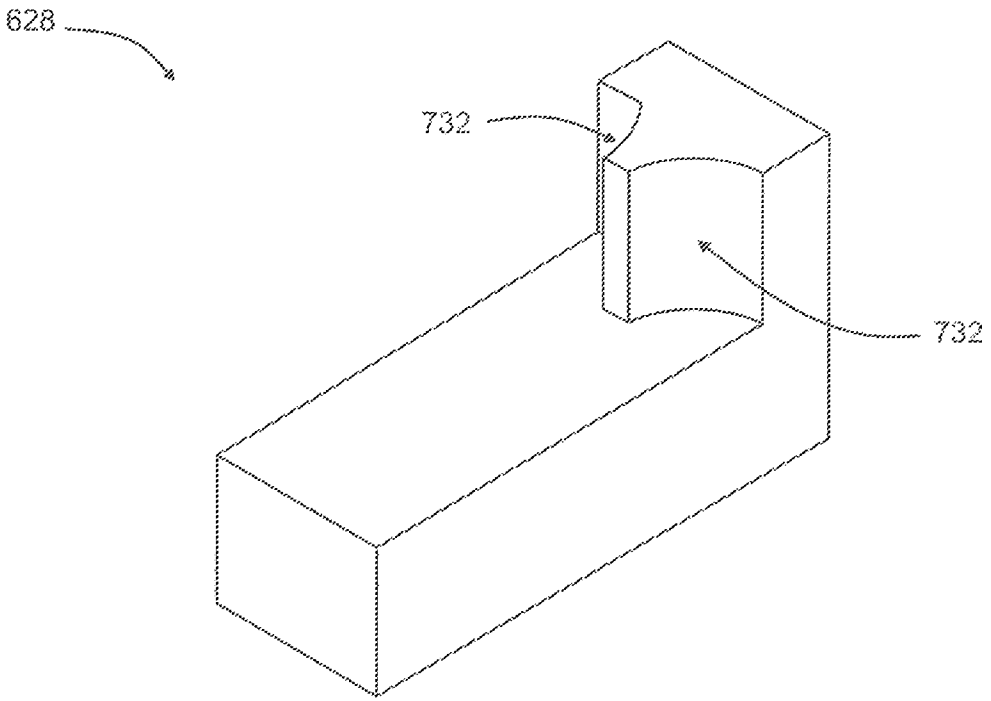
FIG. 7 illustrates a linear stopper piece.

The linear stopper piece 628 is shown in FIG. 7. The linear stopper piece 628 comprises two asymmetrical rounded cut-outs 732. As the bezel 607 is rotated, the two asymmetrical rounded cut-outs 732 of the linear stopper piece 628 engage the teeth of the bezel 607, allowing rotation of the bezel 607 in only one direction until the release button 618 is actuated. The cut-outs 732 are rounded so as to engage the teeth of the bezel 607, and are asymmetric to prevent over tightening of the apparatus. If the bezel 607 is rotated too much, resulting in the over tightening of the apparatus, the asymmetrical cut-outs 732 allow for the linear stopper piece 628 to slip back in between the previous set of teeth of the bezel 607, thus loosening the apparatus. The prevention of over tightening the apparatus is a safety precaution, and is in place to help prevent a band embodiment from cutting off circulation to the hand or any other negative effects over tightening the apparatus may cause.

Figure 8:
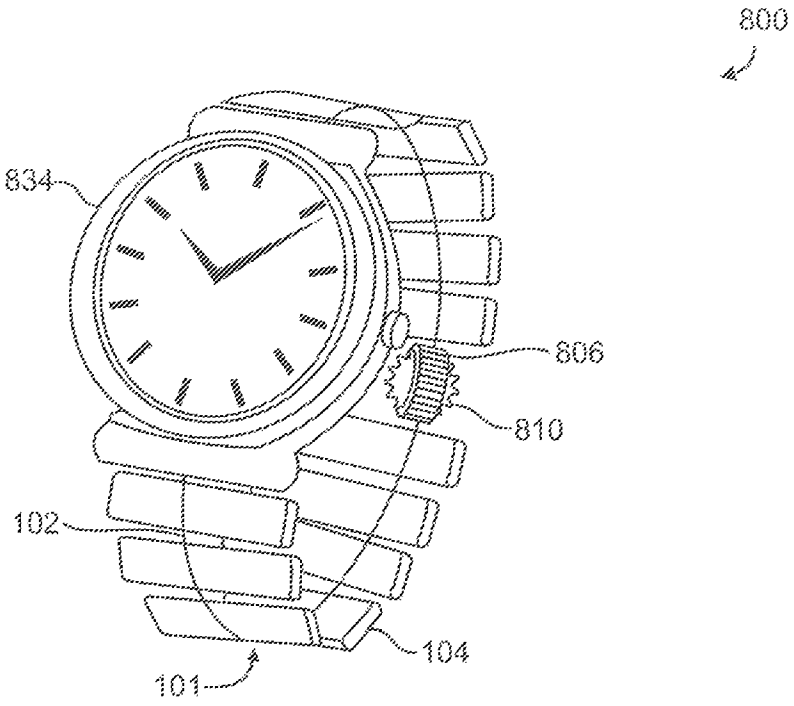
FIG. 8 illustrates a tightening apparatus, according to one embodiment of the invention.

FIG. 8 illustrates one embodiment of the invention in which a tightening apparatus 800 is spaced a distance apart from a device 834. A housing 806 is coupled to a plurality of pieces 104 and encloses a ratchet 810. The ratchet 810 is partially exposed from the housing, and a spool 312 (shown in FIG. 3) is coupled to a surface of the ratchet 810. The ratchet 810 has a center axis with which the spool 312 is rotatable about, and a plurality of teeth. One or more wires 102 are coupled to the spool 312, and run through the center of the plurality of pieces 104. The plurality of pieces 104 and/or the one or more wires 102 are coupled to a device 834, and the device 834 is separated from the housing 806 by the plurality of pieces 104 and the one or more wires 102, such that the device 834 and the housing 806 are in a spaced apart relation. Rotation of the ratchet 810 results in the wire 102 being wound around the spool 312, reducing the distance between at least two pieces of the plurality of pieces 104. The plurality of pieces 104 and the one or more wires 102 may be coupled together to form a band 101, as shown in the figure. The housing 806 may also include a cog 414 (shown in FIG. 4) and/or a bezel 107 (shown in FIG. 4). The tightening apparatus 800 is not limited to including the ratchet 810, and may include the planetary gear system 600 as shown in FIG. 6. The linear stopper piece 628 of FIG. 7 may be included in the housing 806, or the release mechanism shown in FIG. 5 may be included in the housing 806. The device 834 is not limited to being a watch as shown, but may be any device, such as a GPS or a heart rate monitor, and is not limited to being a device 834 worn on the wrist.

While the foregoing is directed to embodiments of the present invention, other and further embodiments of the invention may be devised without departing from the basic scope thereof, and the scope thereof is determined by the claims that follow.

The invention claimed is:

1. A tightening apparatus, comprising:

a housing, wherein a bezel is coupled to the housing and to a perpendicular cog, and wherein the cog is coupled to the ratchet;

a ratchet having a center axis;

a spool coupled to the ratchet, wherein the spool is rotatable about an axis that is collinear with the center axis; and one or more wires coupled to the spool and extending out from the housing, wherein the one or more wires are configured to wind around the spool when the spool rotates, and wherein the length of the one or more wires extending from the housing is adjustable with rotation of the spool.

2. The tightening apparatus of claim 1, further comprising a plurality of pieces are coupled to the housing and the one or more wires, wherein the one or more wires form a closed loop.

3. The tightening apparatus of claim 2, wherein the plurality of pieces comprise metal.

4. The tightening apparatus of claim 2, wherein one end of the one or more wires is fixedly coupled to an end piece of the plurality of pieces.

5. The tightening apparatus of claim 1, further comprising a locking mechanism coupled to the housing and movable into and out of contact with the ratchet.

6. The tightening apparatus of claim 1, wherein the ratchet sits in a recessed circle, the recessed circle having a larger diameter than the ratchet, and the edge of the recessed circle prevents the one or more wires from contacting the ratchet.

7. The tightening apparatus of claim 1, wherein the spool extends perpendicularly from a surface of the ratchet.

8. The tightening apparatus of claim 1, wherein the housing encloses the ratchet and the spool, and wherein the housing is in a spaced apart relation from a device coupled to the one or more wires.

9. A tightening apparatus, comprising:

a housing;

a plurality of pieces coupled together and to the housing;

a central sun gear having a center axis and a plurality of teeth, wherein the sun gear is enclosed in the housing;

two planetary gears coupled to the sun gear, wherein the planetary gears have a plurality of teeth and are enclosed in the housing;

a bezel having a plurality of teeth on an inner diameter of the bezel, wherein the teeth of the bezel are interlocked with the teeth of the two planetary gears, wherein the bezel is coupled to a perpendicular cog, and wherein the cog is coupled to one of the planetary gears;

a spool coupled to the sun gear, wherein the spool is rotatable about an axis that is collinear with the center axis of the sun gear; and one or more wires coupled to the spool and at least a second piece of the plurality of pieces, wherein the one or more wires are configured to wind around the spool when the spool rotates, wherein the second piece is movable from a first position spaced a first distance from a first piece of the plurality of pieces to a second position spaced a second distance from the first piece, and wherein the second distance is less than the first distance.

10. The tightening apparatus of claim 9, wherein the spool is disposed in a recess, the recess allowing the sun gear and the two planetary gears to rotate without interference.

11. The tightening apparatus of claim 9, wherein the housing has at least one opening formed through a side wall thereof.

12. The tightening apparatus of claim 11, further comprising an asymmetrical spring biased linear stopper piece extending through the opening in the housing, the stopper piece prevents the bezel from rotating by engaging the teeth of the bezel, and wherein the portion of the asymmetrical spring biased linear stopper piece extends from the housing.

13. The tightening apparatus of claim 12, wherein the portion of the asymmetrical spring biased stopper piece extending from the housing can be actuated to disengage the teeth of the bezel.

14. The tightening apparatus of claim 11, wherein the housing has at least two openings formed through a side wall, and wherein the one or more wires extend through at least one of the openings.

15. The tightening apparatus of claim 9, further comprising a cover piece coupled to posts that extend through the gears.

16. The tightening apparatus of claim 9, wherein the plurality of pieces are coupled together to form a wristband, the wristband having an adjustable diameter.

17. The tightening apparatus of claim 9, wherein the housing is in a spaced apart relation from a device coupled to the one or more wires.

18. A tightening wristwatch, comprising:

a housing having a plurality of pieces coupled together;

a ratchet having a center axis and coupled to at least a first piece of the plurality of pieces and a last piece of the plurality of pieces, wherein the ratchet has a plurality of teeth;

a spool coupled to the ratchet, wherein the spool is rotatable about an axis that is collinear with the center axis;

a cog perpendicular to the ratchet, wherein the teeth of the cog and the teeth of the ratchet are interlocked;

a bezel coupled to the cog and disposed perpendicular to the cog and parallel with the ratchet, wherein the cog and bezel are interlocked;

a watch coupled to the bezel, wherein the watch is coupled to the plurality of pieces to form a closed loop; and one or more wires coupled to the spool and at least a second piece of the plurality of pieces, wherein the one or more wires are configured to wind around the spool when the spool rotates, wherein the second piece is movable from a first position spaced a first distance from the first piece to a second position spaced a second distance from the first piece, wherein the second distance is less than the first distance, and wherein the diameter of the loop is reduced.

19. The tightening wristwatch of claim 18, further comprising a spring biased pawl adapted to engage the teeth of the ratchet.

20. The tightening wristwatch of claim 19, further comprising a release button adapted to disengage the pawl from the teeth of the ratchet.

21. The tightening wristwatch of claim 18, wherein the one or more wires run though each piece of the plurality of pieces.

22. The tightening wristwatch of claim 18, wherein the housing encloses the ratchet, the spool, and the cog.

* * * * *